US005462413A

United States Patent [19]

Schroeder

[11] Patent Number: 5,462,413

[45] Date of Patent: Oct. 31, 1995

[54] DISPOSABLE RELIEF VALVE SEAT FOR POSITIVE DISPLACEMENT PUMP

[75] Inventor: Alfred A. Schroeder, San Antonio, Tex.

[73] Assignee: Lancer Corporation, San Antonio, Tex.

[21] Appl. No.: 334,173

[22] Filed: Oct. 28, 1994

Related U.S. Application Data

[63] Continuation of Ser. No. 145,802, Oct. 29, 1993, abandoned.

[51] Int. Cl.[6] ..... F04B 49/00; F16K 15/00; F16K 17/00; F16K 21/04

[52] U.S. Cl. ..... 417/310; 417/311; 137/543.23

[58] Field of Search ..... 251/275, 364; 137/543.19

[56] References Cited

U.S. PATENT DOCUMENTS

| | | | |
|---|---|---|---|
| 1,631,372 | 6/1927 | Harris | 251/275 |
| 2,159,720 | 5/1939 | Wahlmark | 417/310 |
| 2,305,519 | 12/1942 | Dunmire | 417/310 |
| 2,348,548 | 5/1944 | Keohler | 251/167 |
| 2,350,905 | 6/1944 | Koehler | 251/167 |
| 2,784,737 | 3/1957 | Kelly | 137/540.11 |
| 3,083,723 | 4/1963 | Duchin | 137/543.23 X |
| 3,085,590 | 4/1963 | McIlhenny | 137/501 |
| 3,272,218 | 9/1966 | Johnson | 137/102 |
| 3,362,680 | 1/1968 | Weiss | 251/360 |
| 3,415,194 | 12/1968 | Connelly | 417/310 X |
| 3,656,870 | 4/1972 | Kusakabe et al. | 417/311 X |
| 4,074,695 | 2/1978 | Weirich et al. | 137/543.23 |
| 4,196,886 | 4/1980 | Murray | 251/357 |
| 4,282,896 | 8/1981 | Makino | 137/543.23 |
| 4,445,532 | 5/1984 | Mitchell | 137/495 |
| 4,542,879 | 9/1985 | Stein | 251/360 |
| 4,740,140 | 4/1988 | Benson | 417/310 X |
| 4,763,636 | 8/1988 | Tamura et al. | 417/311 X |

FOREIGN PATENT DOCUMENTS

| | | | |
|---|---|---|---|
| 476169 | 11/1952 | Italy | 417/311 |

*Primary Examiner*—Richard A. Bertsch
*Assistant Examiner*—Ted Kim
*Attorney, Agent, or Firm*—Donald R. Comuzzi; Christopher L. Makay

[57] ABSTRACT

A positive displacement pump includes a relief valve comprising an valve seat, a needle within the valve seat, a spring forcing the needle within the valve seat, a set screw pressing the spring against the needle and a spacer for mounting the set screw to the housing of the positive displacement pump. The relief passages are formed at the intersection of the valve sleeve and the piston. The valve seat threadably connects within the relief valve passageway to prevent the erosion of the passageway. The valve seat may be constructed from a plastic, hard rubber, or metal material and include a rubberized seal secured at one end of the valve seat. When the valve seat erodes to a point where it provides an insufficient seat for the needle, it is removed from within the relief valve passageway and replaced with a similar valve seat. By protecting the relief valve passageway from erosion by using an inexpensive, removable, and disposable valve seat, costly disposal or machining of the housing of the positive displacement pump is avoided.

6 Claims, 3 Drawing Sheets

DISPOSABLE RELIEF VALVE SEAT FOR POSITIVE DISPLACEMENT PUMP

CROSS-REFERENCE TO RELATED APPLICATIONS

This application is a continuation application of application Ser. No. 08/145,802 filed on Oct. 29, 1993, now abandoned.

BACKGROUND OF THE INVENTION

1. Field of the Invention

The present invention relates to a relief valve for a positive displacement pump and, more particularly, but not by way of limitation, to a removable valve seat for the relief valve needle wherein the removable valve seat prevents damage to the pump housing.

2. Description of the Related Art

An important use for a positive displacement pump includes its connection to the carbonator of a carbonated beverage dispensing system. The positive displacement pump supplies water to the carbonator where it is entrained with $CO_2$ gas to form the carbonated water necessary to furnish a carbonated beverage from the carbonated beverage dispensing system. Specifically, the inlet into the positive displacement pump connects to a water supply, while the outlet from the pump connects to the inlet into the carbonator. The carbonator further connects to a $CO_2$ source which delivers $CO_2$ gas into the carbonator with sufficient pressure (approximately 100 psi) to carbonate the water delivered from the positive displacement pump.

FIG. 1 depicts an existing positive displacement pump suitable for use in carbonated beverage dispensing systems. Such a positive displacement pump is disclosed in U.S. Pat. No. 2,925,786, issued Feb. 23, 1960 to Hill. Positive displacement pump 10 includes housing 11 which typically is fabricated from brass. Housing 11 defines pump chamber 12 which contains a vaned pump rotor (not shown). Inlet 13 connects to a water supply and outlet 14 connects to the carbonator (not shown). Thus, when the carbonator requires water, a pump motor (not shown) activates to turn the rotor within pump chamber 12. As a result, the rotor draws water from the water supply through passageway 23 and forces it through passageway 24, out outlet 14, and into the carbonator. Passageway 23 typically contains a strainer (not shown) which is removed and replaced through opening 22. However, during operation of positive displacement pump 10, opening 22 is sealed using a strainer cap.

Positive displacement pump 10 further includes relief valve 15 which permits a pump user to set the pressure at which positive displacement pump pumps water into the carbonator (approximately 170 psi). Relief valve 15 includes needle 16 which resides within passageway 17 of housing 11. Spring 18 resides between the head of needle 16 and set screw 19 to apply pressure against needle 16 and force needle 16 within passageway 17. Set screw 19 threadably connects to housing 11 and provides adjustments in the tension spring 18 exerts against needle 16. Those adjustments provide different pumping pressures for positive displacement pump 10 because they change the point at which relief valve 15 opens to bypass the water driven from pump chamber 12. That is, when the pressure of the water pumped from pump chamber 12 exceeds the user set pressure level, the water enters passageway 17 and forces needle 16 away from edges 20 and 21 at the outlet from passageway 17. Consequently, the pumped water flows through passageway 17 thereby stopping the delivery of water into the carbonator to prevent damage to either the carbonator or the pump motor.

Without relief valve 15, positive displacement pump 10 would damage the carbonator if the pressure of the water delivered into the carbonator exceeded the user set level. That is, if relief valve 15 did not bypass the pumped water when it exceeded the user set level, positive displacement pump 10 would pump water into the carbonator until the seals on the carbonator burst. Alternatively, if the pressure in the carbonator overcomes the ability of the pump motor to drive water into the carbonator, the rotor would seize, resulting in the pump motor burning out.

Accordingly, relief valve 15 plays an integral part in the proper functioning of positive displacement pump 10. Unfortunately, because housing 11 comprises brass, the flow of water past edges 20 and 21 of passageway 17 causes erosion of those edges. That is, the velocity of the water combined with the minerals in the water wear edges 20 and 21 away. When the flowing water sufficiently rounds edges 20 and 21, needle 16 no longer seats sufficiently over the outlet from passageway 17 to prevent water flow through passageway 17 at pressures below the user set pump pressure level. Consequently, positive displacement pump 10 fails to supply water to the carbonator at a sufficient volume and pressure to permit proper carbonation. Without proper carbonation, the carbonated beverage dispensed from the carbonated beverage dispensing system tastes poorly.

Presently, positive displacement pumps such as positive displacement pump 10 operate effectively for less than a year. When positive displacement pump 10 ceases to operate at an acceptable level, pump housing 11 is typically remachined. Unfortunately, remachining is expensive and often impractical because the necessary equipment might not be available. Furthermore, edges 20 and 21 are often eroded to the point where remachining of pump housing 11 is impossible. In such instances, positive displacement pump 10 is replaced and pump housing 11 is discarded. However, the discarding of pump housing 11 is not practical because it is extremely expensive in comparison to the remaining parts of positive displacement pump 10. Thus, the disposal of pump housing 11 is an extremely wasteful consequence of the erosion occurring at edges 20 and 21 of passageway 17.

Accordingly, a positive displacement pump and relief valve design is required which prevents the unnecessary machining or disposing of the entire pump housing when the edges at the outlet from the relief valve passageway erode.

SUMMARY OF THE INVENTION

In accordance with the present invention, the passageway for the relief valve of a positive displacement pump includes an inexpensive, removable, and disposable valve seat which protects the pump housing from erosion. The positive displacement pump further includes a needle seated within the valve seat. A spring maintains the needle within the valve seat and, further, operates to regulate the needle to control the fluid pressures which open the relief valve. A set screw retains the spring against the needle and provides an adjustment of the force the spring exerts against the needle. Adjustments in the spring's compressive force effected via the set screw allow a pump user to regulate the pressure of the fluid pumped from the positive displacement pump. A spacer threadably connects within an opening into the housing of the positive displacement pump to provide a mount for the set screw.

The valve seat comprises a body portion fabricated from a plastic material having a rubber seal mounted at one end through either a chemical bond or an adhesive. Alternatively, the valve seat may be formed with no seal and be fabricated entirely from a plastic material, a hard rubber material, or a metal. Further, the body portion may be fabricated from a metal which has a rubber seal mounted at one end through an adhesive.

The valve seat threadably connects within the relief valve passageway of the positive displacement pump to protect the relief valve passageway from erosion. Thus, the water flowing through the relief valve passageway contacts the valve seat and not the relief valve passageway. Consequently, only the valve seat erodes and not the pump housing. When the valve seat erodes to a point where the positive displacement pump no longer operates at an acceptable level, it is removed and replaced with a new valve seat. The valve seat, therefore, prevents the costly remachining or disposal of the brass housing of the positive displacement pump.

It is, therefore, an object of the present invention to provide an valve seat for a relief valve passageway of a positive displacement pump which protects the relief valve passageway from erosion.

It is another object of the present invention to provide an valve seat for a relief valve passageway of a positive displacement pump which is inexpensive, removable, and disposable to allow easy replacement when eroded by fluid flowing over it.

It is a further object of the present invention to provide an valve seat that threadably connects within the relief valve passageway to allow easy removal.

It is still a further object of the present invention to provide an valve seat with a seal that prevents leakage of fluid through the relief valve during pump operation.

Still other objects, features, and advantages of the present invention will become evident to those skilled in the art in light of the following.

DETAILED DESCRIPTION OF THE PREFERRED EMBODIMENT

Figure 1:
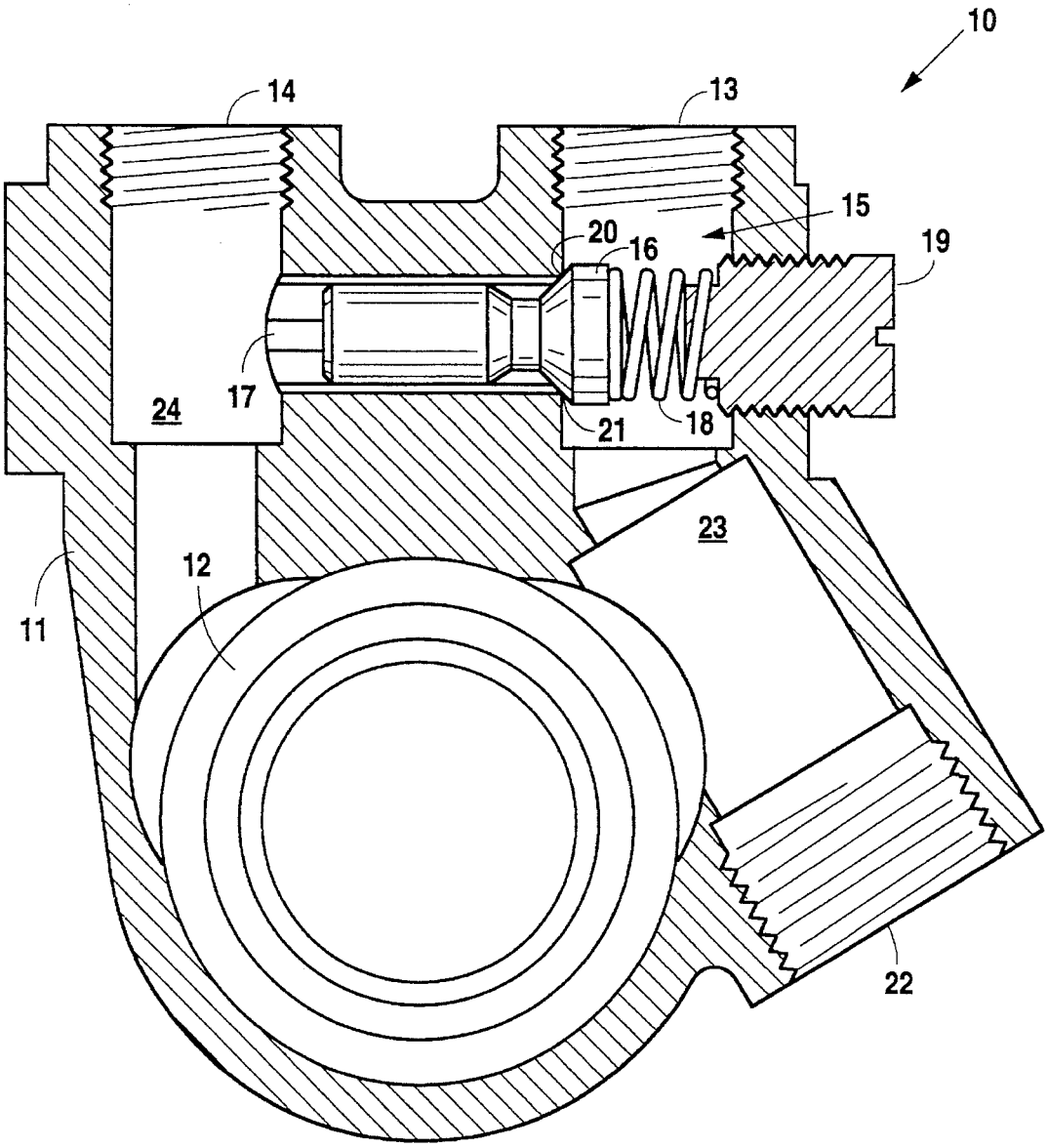
Fig. 1 ( PRIOR ART )
FIG. 1 is a front elevation view in cross-section depicting a prior art positive displacement pump.
Figure 2:
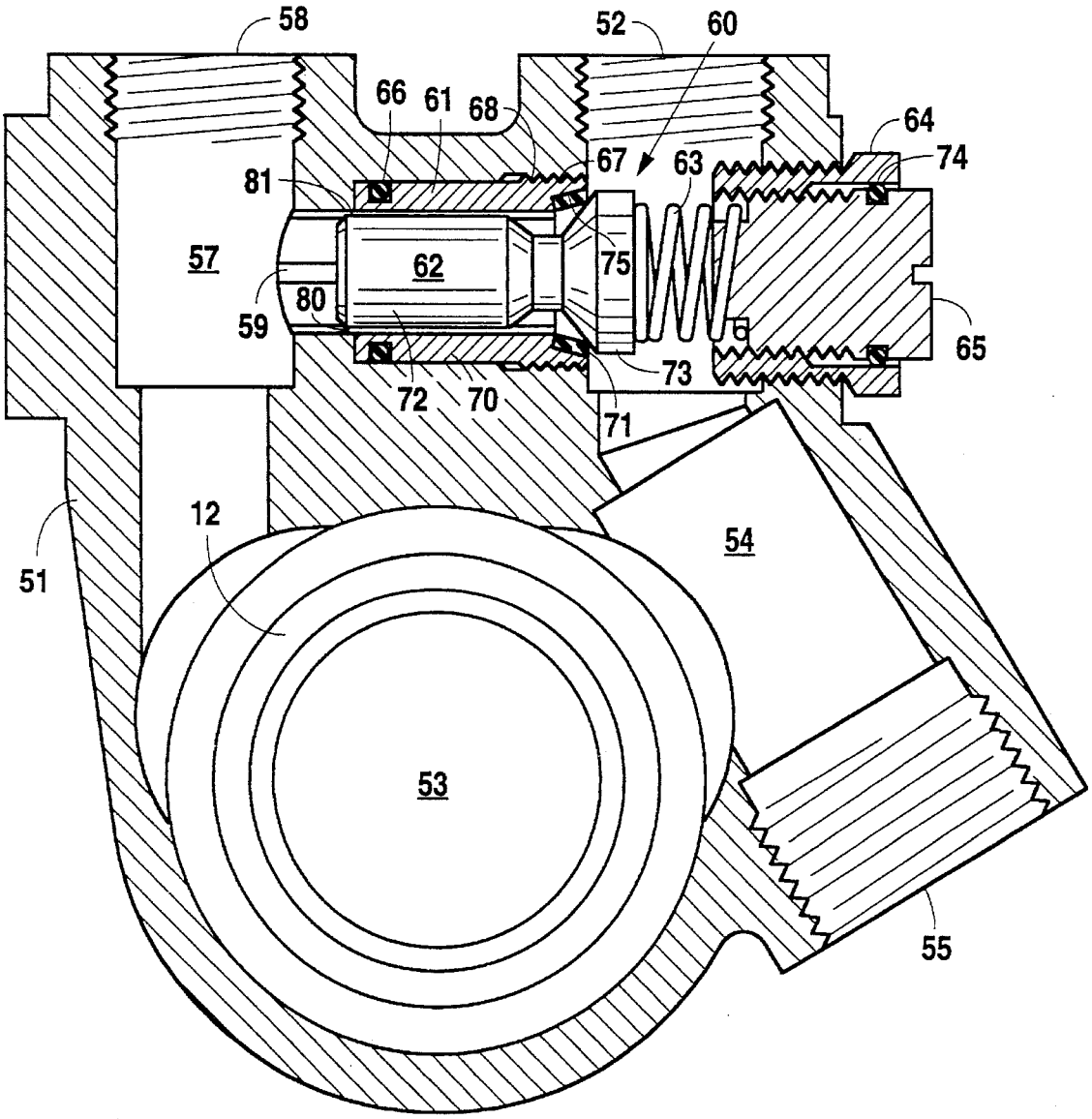
FIG. 2 is a front elevation view in cross-section depicting the relief valve and valve seat of the present invention.
Figure 3:
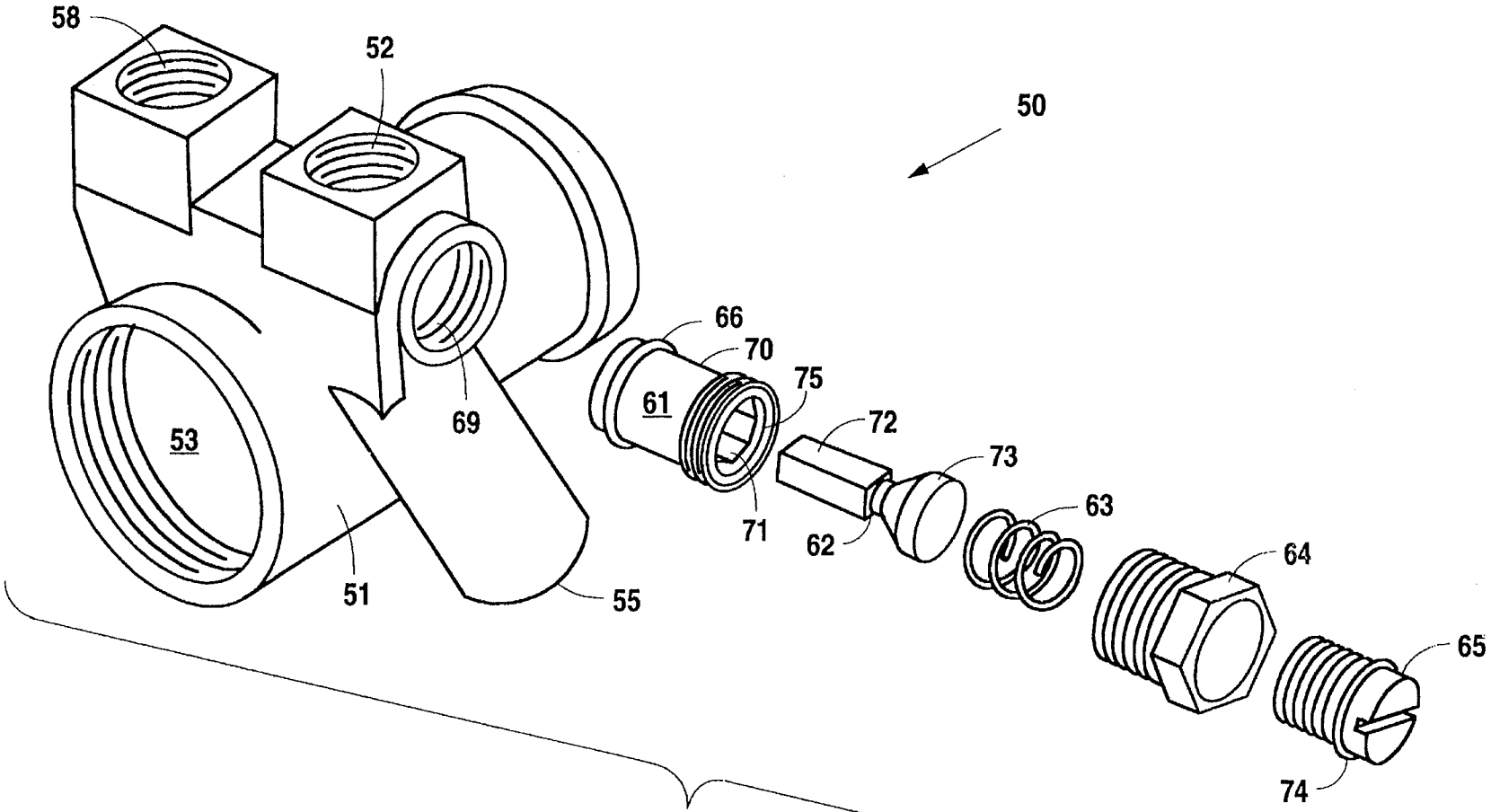
FIG. 3 is a perspective view depicting the pump housing and the relief valve of the present invention.

As shown in FIGS. 2 and 3, positive displacement pump 50 includes housing 51 which is fabricated from brass. Inlet 52 connects to a fluid source and receives the fluid which enters pump chamber 53 via passageway 54. Passageway 54 typically contains a strainer (not shown) which is removed and replaced through opening 55. However, during operation of the pump 50, opening 55 is sealed using any suitable means such as a strainer cap. The fluid enters pump chamber 53 where a vaned rotor (not shown) forces the fluid into passageway 57 and out outlet 58.

In this preferred embodiment, inlet 52 connects to any suitable water source such as a public water line and outlet 58 connects to a carbonator of a carbonated beverage dispensing system. Pump 50 delivers the water into the carbonator which carbonates the water and delivers the carbonated water to dispensing valves for dispensing with soda syrup to produce a carbonated beverage. However, one skilled in the art will recognize that pump 50 may be utilized in any situation requiring the pumping of fluids using a positive displacement pump.

Positive displacement pump 50 further includes relief valve 60 which permits a pump user to adjust the pressure of the fluid pumped from outlet 58. Relief valve 60 comprises valve seat 61, needle 62, spring 63, spacer 64 and set screw 65. Valve seat 61 includes threads 67 which engage threads 68 of passageway 59 to secure valve seat 61 within passageway 59. The inner surface of valve seat 61 includes grooves that define an octagonal shape to allow its insertion in and removal from passageway 59 with an Allen wrench. Accordingly, with needle 62, spring 63, spacer 64, and set screw 65 removed, an Allen wrench fits within valve seat 61 to allow placement of valve seat 61 through opening 69 of housing 51 and into passageway 59. The Allen wrench is then used to screw valve seat 61 within passageway 59 such that threads 67 and 68 engage. Valve seat 61 further includes O-ring 66 which provides a fluid seal for valve seat 61 within passageway 59.

After valve seat 61 is threadably secured within passageway 59, needle 62 which includes body 72 and head 73 is inserted therein. Body 72 has a quadrilateral shape and fits within valve seat 61 such that channels 80 and 81 are formed between body 72 and the inner surface of valve seat 61. With body 72 inserted into valve seat 61, head 73 abuts against the outlet from valve seat 61 to seal channels 80 and 81. Needle 62 may be fabricated from any suitable material such as plastic or hard rubber.

Once needle 62 has been inserted within valve seat 61, spacer 64 is threadably secured within opening 69 to provide a mount for set screw 65. Spring 63 resides across inlet 52 to force needle 62 within valve seat 61 such that head 73 seals the outlet from valve seat 61. Set screw 65 threadably mounts within spacer 64 to press spring 63 against head 73 of needle 62. Set screw 65 includes O-ring 74 which provides a fluid seal between set screw 65 and spacer 64. Set screw 65 retains spring 63 against needle 62 to provide an adjustment of the force spring 63 exerts against needle 62. Adjustments in the compressive force spring 63 exerts against needle 62 allow a pump user to regulate the pressure of the fluid pumped from positive displacement pump 50.

In this preferred embodiment, valve seat 61 comprises body 70 which includes annular lip 75 having seal 71 bonded therein. Body 70 comprises a plastic such as nylon combined with glass, carbon, or a combination of glass and carbon or polyethersulfone formed using any standard molding process such as insert molding. Seal 71 comprises a rubber material that chemically bonds to body 70 during the molding process form an integral piece. Alternatively, if a rubber material which does not chemically bond with plastic is utilized, an adhesive may be used to secure seal 71 to body 70. Thus, valve seat 61 provides for an improved relief valve because the rubber material which comprises seal 71 furnishes a better fluid seal between valve seat 61 and head 73 of needle 62. That is, when needle 62 remains in its sealed position abutting seal 71, there is no leakage past head 73 as is common in standard positive displacement pumps.

Although this preferred embodiment discloses a plastic body formed integrally with a rubber seal, one skilled in the art will recognize that valve seat 61 could be formed entirely from plastic, hard rubber, or a metal such as brass. Furthermore, body 70 could be formed from a metal such as brass and seal 70 secured thereto using an adhesive. Essentially, any inexpensive material having sufficient strength and heat resistance characteristics which is moldable into the shape of valve seat 61 may be utilized.

In operation, a motor (not shown) drives the rotor which draws fluid from a fluid source and pumps the fluid from outlet 58 at a pressure set by a pump user using relief valve 60. Specifically, set screw 65 allows adjustments in the pressure at which positive displacement pump 50 pumps fluid. For example, as a pump user tightens set screw 65, spring 63 exerts an increased compressive force against needle 62. As a result, positive displacement pump 50 pumps at a higher pressure because a higher pressure must be exerted against needle 62 to force head 73 from seal 71, thereby opening channels 80 and 81. Alternatively, if a pump user loosens set screw 65, the pressure against needle 62 required to cause the opening of channels 80 and 81 lessens so that the maximum pressure of the fluid pumped from outlet 58 is reduced. However, in either instance, once channels 80 and 81 open, pump 50 ceases to pump fluid from outlet 58. Accordingly, adjustments in the compressive force spring 63 applies against needle 62 permits regulation of the pumping pressure from positive displacement pump 50.

Relief valve 60 further prevents positive displacement pump 50 from damaging the system to which it is attached. That is, if relief valve 60 did not bypass the pumped water when it exceeded the user set level, positive displacement pump 50 would pump water into the system until the seals of the components of the system burst. Alternatively, if the pressure in the system overcomes the ability of the pump motor to drive fluid into the system, the rotor would seize, resulting in the pump motor burning out.

When the output pressure of the fluid from pump chamber 53 exceeds the user set value, relief valve 60 opens as previously described to bypass the fluid pumped from pump chamber 53 by the rotor. The fluid enters passageway 59, travels over the inner surface of valve seat 61 via channels 80 and 81, and exits valve seat 61 into passageway 54 for reentry into pump chamber 53. Similar to standard positive displacement pump relief valve passageways, seal 71 and body 70 encounter erosion due to the water and minerals flowing over their surfaces. At some point during the sustained operation of pump 50, valve seat 61 experiences sufficient erosion to reduce both the volume and pressure of the fluid pumped from positive displacement pump 50 to a level requiring replacement.

However, unlike standard positive displacement pumps, the expensive and impractical discarding or remachining of pump housing 51 does not occur. Instead, valve seat 61 is removed, disposed and then replaced with a new valve seat as previously described. Accordingly, valve seat 61 provides an economical solution to the problem of relief valve passageway erosion.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

I claim:

1. A disposable component for a relief valve that regulates the flow of fluid through a relief passageway of a positive displacement pump, comprising:

a hollow sleeve formed to fit into the relief passageway of the positive displacement pump; and longitudinal grooves on the interior surface of said hollow sleeve for permitting fluid passage and for providing an engaging surface that allows said hollow sleeve to be placed into and removed from the relief passageway of the positive displacement pump.

2. The disposable component according to claim 1 wherein said hollow sleeve includes a first end and a second end having an annular lip.

3. The disposable component according to claim 2 further comprising a seal secured within said annular lip at the second end of said hollow sleeve.

4. The disposable component according to claim 1 wherein said hollow sleeve includes threads on its exterior surface that secure said hollow sleeve into the relief passageway of the positive displacement pump.

5. The disposable component according to claim 1 wherein said hollow sleeve includes an O-ring about its exterior surface to provide a fluid seal between the exterior surface of said hollow sleeve and the relief passageway of the positive displacement pump.

6. The disposable component according to claim 1 wherein the relief valve, comprises:

a needle slidably mounted inside said hollow sleeve, said needle including a head portion at one end; and means for biasing said needle into sealing relationship with said head portion abutting the rear end of said hollow sleeve.

* * * * *